US008419565B2

(12) United States Patent
Karube

(10) Patent No.: US 8,419,565 B2
(45) Date of Patent: Apr. 16, 2013

(54) GRIP STRUCTURE WITH WEIGHT AND GOLF CLUB

(76) Inventor: Nakaba Karube, Minoh (JP)

( * ) Notice: Subject to any disclaimer, the term of this patent is extended or adjusted under 35 U.S.C. 154(b) by 0 days.

(21) Appl. No.: 13/560,586

(22) Filed: Jul. 27, 2012

(65) Prior Publication Data

US 2012/0289356 A1 Nov. 15, 2012

Related U.S. Application Data

(62) Division of application No. 12/687,635, filed on Jan. 14, 2010, now abandoned.

(30) Foreign Application Priority Data

Nov. 20, 2009 (JP) ..... 2009-265215

(51) Int. Cl.
*A63B 53/16* (2006.01)

(52) U.S. Cl.
USPC ..... 473/297; 473/300

(58) Field of Classification Search ..... 473/300–303, 473/568, 552–557, 294–299, 282, 285–286
See application file for complete search history.

(56) References Cited

U.S. PATENT DOCUMENTS

| | | | | |
|---|---|---|---|---|
| 2,782,035 | A | | 2/1957 | East |
| 4,380,337 | A | | 4/1983 | DiMatteo |
| 4,822,052 | A | | 4/1989 | Dimmick et al. |
| 4,957,293 | A | | 9/1990 | Byrd |
| 5,322,290 | A | | 6/1994 | Minami |
| 5,351,949 | A | * | 10/1994 | Fox et al. ..... 473/285 |
| 5,759,111 | A | | 6/1998 | Clark |
| 5,782,705 | A | | 7/1998 | Solari |
| 6,666,777 | B1 | | 12/2003 | Lamkin et al. |
| 7,399,235 | B2 | | 7/2008 | Gill et al. |
| 7,399,236 | B2 | | 7/2008 | Takeuchi |

FOREIGN PATENT DOCUMENTS

| | | |
|---|---|---|
| JP | 8-332250 A | 12/1996 |
| JP | 2000-300706 A | 10/2000 |
| JP | 2001-037930 A | 2/2001 |
| JP | 2008-137151 A | 6/2008 |

* cited by examiner

*Primary Examiner* — Stephen L. Blau
(74) *Attorney, Agent, or Firm* — Westerman, Hattori, Daniels & Adrian, LLP

(57) ABSTRACT

There is provided a golf club where a separation of a weight for swingweight adjustment can be certainly prevented and the weight can be easily detached/attached and replaced; concurrently, the center of gravity is slanted toward the shaft side, and the center of gravity position can be stabilized. The golf club 10 has a grip part 16 and a weight part 18. A threaded shaft 26 is established at the grip part 16 side, and a female screw part 22 is established in the weight part 18. In the gold club 10, the grip part 16 and the weight part 18 can be integrated in the state where a spring washer 30 is interposed, by screwing a threaded shaft 26 with a female screw part 22 under a condition where the spring washer 30 is mounted to the threaded shaft 26.

4 Claims, 9 Drawing Sheets

GRIP STRUCTURE WITH WEIGHT AND GOLF CLUB

The present application is a divisional application of U.S. Ser. No. 12/687,635, filed on Jan. 14, 2010, which is claiming priority of Japanese Patent Application No. 2009-265215 filed on Nov. 20, 2009.

TECHNICAL FIELD

The present invention relates to a grip structure where a weight is mounted for a golf club or the like, and it has a special feature in the fixation structure of swingweight.

BACKGROUND TECHNOLOGY

Conventionally, a golf club where a weight for swingweight adjustment secured to a shaft or grip with inserting or a screw has been provided, and specifically, for example, golf clubs equipped with a swingweight disclosed in Patent Literature 1 to Patent Literature 3 are provided.

In the golf club disclosed in Patent Literature 1, a weight for swingweight adjustment is mounted to a hosel placed for mounting a club head and a shaft via adhesion. The weight adopted herein has shape having a cylindrical body and a flange part, and the weight is secured to a position at the tip side of the shaft (at the club head side) by inserting the body into the shaft; concurrently, by sandwiching the flange part between the end of the shaft and a bottom surface of the hosel.

Further, the golf club disclosed in Patent Literature 2 is configured to enable to accommodate many spherical weight materials functioning as a weight for weight adjustment in a section established inside the grip, and the swingweight can be adjusted by adjusting the number of the weight materials.

In addition, the golf club disclosed in Patent Literature 3 is lack of the vicinity of centroid of the club head in the golf club, and has a configuration where a weight having a shaft line in a direction at intersected with the shaft line of the grip from the tip at the grip side in the golf club that is lack of the vicinity of centroid of the club head is mounted.

PRIOR ART LITERATURES

Patent Literatures

[Patent Literature 1] Japanese Utility Model Registration Publication No. 3018130

[Patent Literature 2] Japanese Unexamined Patent Application Publication H5-220242

[Patent Literature 3] Japanese Unexamined Patent Application Publication 2009-136641

SUMMARY OF THE INVENTION

Problem to be Solved by the Invention

When the weight for swingweight adjustment is secured by inserting or screwing as in the conventional golf clubs, the anchorage strength may be reduced because of gradual slackening of the screw for securing the weight, due to an effect of oscillation or fictitious force to be applied during using the clubs. Further, if the golf club is continuously used under the condition where the weight for swingweight adjustment is not firmly secured, there are other problems that the weight may be lost or may cause injury because the weight is separated (fixation).

Further, when the weight is mounted to the inside of the hosel as in the golf club described in Patent Literature 1, there is a problem that the weight cannot be easily replaced or adjusted. When hitting a ball higher or stronger is considered, even though it is desirable to slant the center of gravity to the shaft side, if the configuration disclosed in Patent Literature 1 is adopted, the center of gravity is slanted toward the club head side by mounting the weight, and there is another problem that it becomes difficult to hit a ball higher (attachment/detachment and replacement).

In addition, when it is structured such that a weight material is accommodated within a section formed inside a grip as in the golf club disclosed in Patent Literature 2, if a cap established for the purpose of closing an opening portion of this section comes off, the spherical weight material flies off the opening portion and it is possible to cause injury or loss of the weight material.

In addition, in the golf club disclosed in Patent Literature 2, it is possible that the center of gravity position may be slightly changed due to how much the spherical weight, which is a weight material, is filled, and while a user repeats golf swing, it is possible that the weight material may move or be eccentrically located within the section established in the grip, and then, the center of gravity position may be changed. In other words, there is the problem from the viewpoint of fixation in the golf club disclosed in Patent Literature 2 as similar to the case of Patent Literature 1.

Therefore, it is difficult to stabilize the center of gravity position in the prior art golf clubs, and a poor usability is a problem. Furthermore, in Patent Literature 3, how a weight is specifically mounted to the tip at the grip side is not disclosed at all.

Then, in order to solve the problems, the objective of the present invention is to provide a grip structure with a weight for certainly preventing separation of the weight for swingweight adjustment, for enabling to stabilize the center of gravity position by certainly slanting the center of gravity toward the shaft side, and for enabling to easily attach/detach and replace the weight.

Means for Solving the Problem

In order to solve the problems, the present invention provides the grip structure with a weight, comprising:

a grip part, and a weight part equipped with a weight for swingweight adjustment to be detachably/attachably mountable to a tip of the grip part, wherein the center of gravity of the weight part is substantially positioned on the shaft center of the grip part.

According to such configuration, it is possible to certainly prevent the separation of the weight for swingweight adjustment, and to stabilize the center of gravity position by certainly slanting the center of gravity toward the shaft side, and, a grip structure with a weight where the weight can be easily attached/detached and replaced can be realized. In particular, because the center of gravity of the weight part exists on the shaft center of the grip, the swingweight can be easily adjusted so as to position the center of gravity at an appropriate balance point. Further, a grip structure with a weight that can stabilize the center of gravity position and excels in usability can be provided.

It is preferable that the grip structure with a weight relating to the present invention has a configuration where a threaded shaft is established at either side of the grip part or the weight part and a female screw part is established at the other side of the grip part or the weight part where the threaded shaft is not established (First Embodiment).

In the grip structure with a weight relating to the present invention having such configuration, a spring washer is mounted to the threaded shaft, and it is possible to integrate the grip and the weight in the state where the spring washer intervenes by screwing the threaded shaft with the male screw.

Further, it is preferable that the grip structure with a weight of the present invention has a configuration where a convex joining part is established on either one or both end surfaces of the grip portion or/and the weight part, and a concave joining part where a joint structure is formable by fitting with the convex joining part (Second Embodiment).

The grip structure with a weight of the present invention having such configuration enables to integrate the grip part and the weight part by forming the joint structure comprising a combination of the convex joining part and the concave joining part at a plurality of sections.

Further, the grip structure with a weight of the present invention is preferably characterized such that the grip part has a cylindrical grip body and a weight connection part;

the weight connection part is placed at the end of the grip part, and is equipped with a slot and is elastically deformable;

the weight part is equipped with a shaft-like insertion part to be insertable into the slot, and the insertion part and the weight are detachably/attachably integrated;

the insertion part has a diameter-enlarging part whose external diameter expands to the size more than the opening size of the slot gradually, and an engagement part that is positioned at the weight side with regard to the diameter-enlarging part, and that is engageable with the slot, and a step difference is formed between the diameter-enlarging part and the engagement part; and the grip part and the weight part are integrable by inserting the insertion part into the slot and engaging the engagement part with the slot (Third Embodiment).

Further, the grip structure with a weight of the present invention is desirably characterized such that the grip body is elastically deformable; and the weight connection part is harder than the grip body.

Further, the present invention provides a golf club equipped with the grip structure with a weight of the present invention.

Effect of the Invention

According to the grip structure with a weight of the present invention, it is possible to certainly prevent the separation of the weight for swingweight adjustment and to certainly slant the center of gravity toward the shaft side and to stabilize the center of gravity position, and, the weight can be easily attached/detached and replaced. In particular, since the center of gravity of the weight part exists on the shaft center of the grip part, the swingweight can be easily adjusted so as to position the center of gravity at an appropriate balance point. Further, a golf club where the center of gravity position can be stabilized, and that excels in usability upon golf swing can be provided.

In First Embodiment of the grip structure with a weight of the present invention, a spring washer is mounted to a threaded shaft established at either side of the grip part or the weight part, and the grip part and weight part can be integrated by screwing the threaded shaft with the screw part established at the other of the grip part and the weight part. When the grip part and the weight part are integrated as described above, because the spring washer intervenes between both, even if the use is continued throughout a long term, the anchorage strength of the weight part will not be decreased. Therefore, in the First Embodiment of the present invention, even if this is used throughout a long term, inconvenience, such as separation from the grip part due to loosing the weight part, will hardly occur.

Further, as described above, in the First Embodiment of the present invention, the spring washer is interposed between the grip part and the weight part, and then the weight part can be secured to the grip part only by screwing the threaded shaft with the female screw part. Therefore, in the First Embodiment of the present invention, the weight part can be easily attached/detached and replaced, and the swingweight can be easily adjusted. In addition, because the weight part is mounted to the grip part in the golf club of the present invention, the center of gravity can be easily and certainly slanted toward the grip side.

Further, in Second Embodiment of the grip structure with a weight of the present invention, because it is possible to form the joint structure where the convex joining part placed on either one or both end surfaces of the grip part and the weight part is fitted into the concave joining part at a plurality of sections at a plurality of sections, it can certainly prevent rotation and separation of the weight part from the grip part. Further, in Second Embodiment of the present invention, since the weight part is mounted onto the end surface of the grip part, the center of gravity position can be eccentric not at the club head side but toward the grip side. Therefore, in Second Embodiment of the present invention, it becomes possible to easily adjust the golf club so as to position the center of gravity at an appropriate balance point based upon the user's golf swing, by adjusting weight of the weight part.

In addition, in Second Embodiment of the present invention, the joint structure can be formed by inserting the convex joining part into the concave joining part, and it is possible to attach/detach the weight part to/from the grip part.

In Third Embodiment of the grip structure with a weight relating to the present invention, since a weight connection part placed at the grip body side is elastically deformable, while an insertion part is inserted into the slot, if suppress strength is further applied to the weight part in the axial direction of the insertion part, while the slot is pushed and expanded by the diameter-enlarging part, the insertion part is gradually inserted. Further, when the weight part is pushed until an engagement part passes a step difference and reaches the slot, the opening size of the slot is restored due to elastic force of the weight connection part, and the engagement part is firmly engaged into the slot. Therefore, in Third Embodiment of the present invention, the weight part can be firmly secured by merely pressing the weight part axially in the state where the insertion part is inserted into the slot. Further, in Third Embodiment of the present invention, because the weight part is mounted to the end of the grip body, the golf club can be easily adjusted so as to have the center of gravity position reach a desired position on the shaft center of the grip part as similar to the grip structure of the present invention.

Further, the grip structure with a weight of the present invention enables to further solidly secure the weight part by using a harder material than the grip body for the weight connection part.

Since the golf club of the present invention is equipped with the grip structure with a weight of the present invention, separation of the weight for swingweight adjustment can be certainly prevented, and the center of gravity position can be easily adjusted and the weight can be easily attached/detached and replaced.

EMBODIMENT OF THE INVENTION

Subsequently, as preferred embodiments of the grip structure with a weight of the present invention, embodiments of the golf club equipped with the grip structure with a weight of the present invention (First Embodiment and Second Embodiment) are explained in detail with reference to drawings.

First Embodiment

Figure 1:
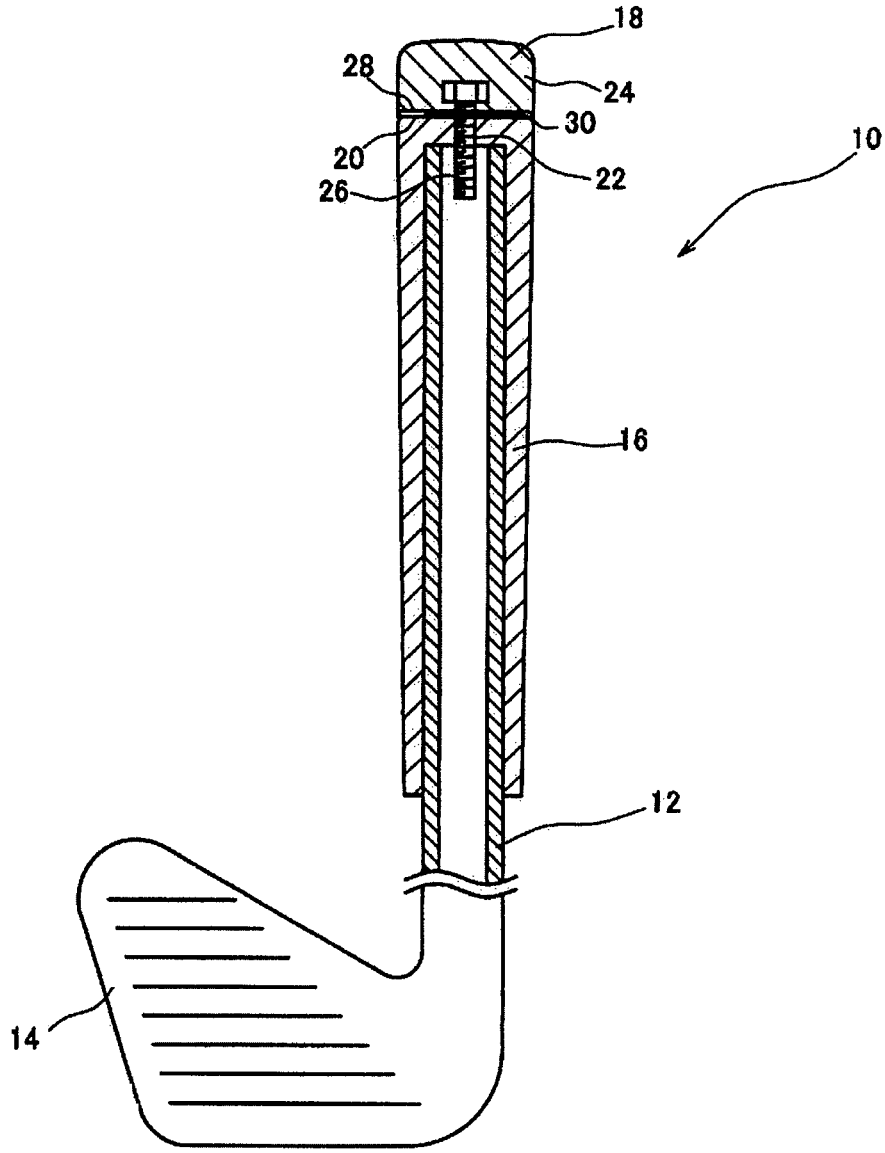
FIG. 1 is a cross sectional view showing the golf club relating to First Embodiment of the present invention.

A golf club 10 relating to First Embodiment of the present invention is explained with reference to drawings. As shown in FIG. 1, in the golf club 10, a club head 14 is mounted to the tip side of a shaft 12; concurrently, a weight part 18 is mounted to a grip part 16 placed at the end side. The shaft 12 is formed with a hollow shaft body as similar to the known prior art, and the club head 14 is formed with the similar one to that of the known prior art.

Figure 2:
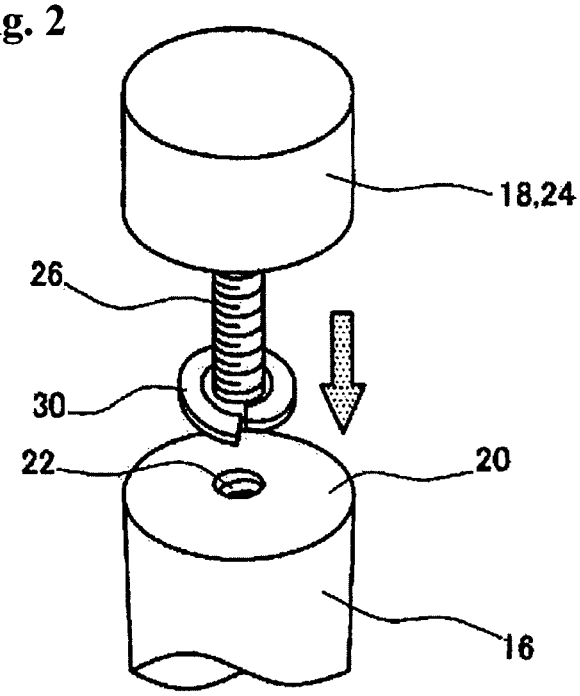
FIG. 2 is an exploded perspective view showing the grip part and the weight part of the golf club shown in FIG. 1.

As shown in FIG. 1 and FIG. 2, the grip part 16 is a substantially-cylindrical portion to be gripped by a user. An axially-penetrated female screw part 22 is placed in a substantially-center of an end surface 20 of the grip part 16. The female screw part 22 is communicated with the hollow portion of the shaft 12, and the weight part 18 is an integration of a weight for swingweight adjustment and a threaded shaft 26 in the golf club 10. The weight 24 is a cylindrical member having substantially the same diameter as the grip 16, and the threaded shaft 26 is secured to the weight 24 and almost perpendicularly protrudes from the end surface 28 side of the weight 24.

As shown in FIG. 1 and FIG. 2, the weight part 18 is for mounting a spring washer 30 to the threaded shaft 26; concurrently, is integrated with the grip part 16 by screwing the threaded shaft 26 with the female screw 22 established at the grip part 16 side.

Due to this design, the spring washer 30 is sandwiched between the end surface 20 of the grip part 16 and the end surface 28 of the weight part 18, and the grip part 16 will never loosen but is firmly secured to the weight part 18. Therefore, even if the gold club 10 is used throughout a long term, the joint strength at the joint structure part formed with the female screw part 22 and the threaded shaft 26 will not be decreased, and the weight part 18 will not be separated from the grip part 16. Further, because the weight part 18 is not separated, a loss of the weight part 18 and any collateral damage, such as user's injury due to the weight part 18 becoming a projectile.

With the golf club 10, the weight part 18 can be mounted to the grip part 16 only by screwing the threaded shaft 26 with the female screw part 22 while the spring washer 30 is mounted. Therefore, with the golf club 10, the weight part 18 can be easily detached/attached and replaced, and a swingweight can be easily adjusted.

Further, since the golf club 10 is mounted to the grip part 16 positioned at the end side of the shaft 12, it is possible to easily and certainly slant the center of gravity toward the grip side. Therefore, the golf club 10 can easily and certainly respond to a [user's] desire to hit a ball much higher or stronger.

Further, in the golf club 10, since the shaft center positions of the weight part 18 and the grip part 52 are substantially the same and the center of gravity of the weight part 18 exists at a position passing through the shaft center of the grip part 52, a swingweight can be easily adjusted so as to position the center of gravity at an appropriate balance point. Further, since the weight part 18 is firmly secured at the above-mentioned position, the center of gravity position of the golf club 10 is always stable and the golf club 10 excels in usability.

Furthermore, taking release of the end portion of the threaded shaft 26 screwed with the female screw part 22 into consideration, the configuration where the threaded shaft 26 is placed at the weight part 18 side and the female screw part 22 is placed at the grip part 16 side, and the hollow portion formed inside the shaft 12 is communicated with the female screw part 22 is exemplified in the present embodiment, but the present invention shall not be limited to this configuration.

Figure 3:
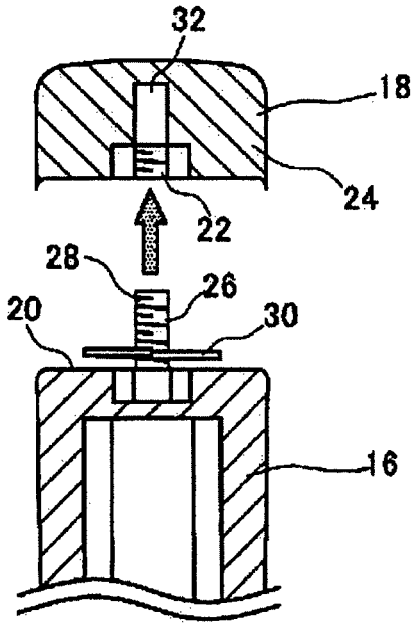
FIG. 3 is a main part enlarged cross-sectional view showing a modified example of the golf club shown in FIG. 1.

For example, contrary to the embodiment, as shown in FIG. 3, it may be configured such that the female screw part 22 is placed at the weight part 18 side and the threaded shaft 26 is placed at the grip part 16 side. Furthermore, in the case of such configuration, as shown in FIG. 3, it is desired to establish a concave part 32 that can release the threaded shaft 26 to the weight part 18 side.

Second Embodiment

Sequentially, a golf club 50 relating to Second Embodiment of the present invention is explained in detail with reference to drawings. Furthermore, any portions in common with those in the golf club 10 are marked with the same symbols, and detailed explanations are omitted.

Figure 4:
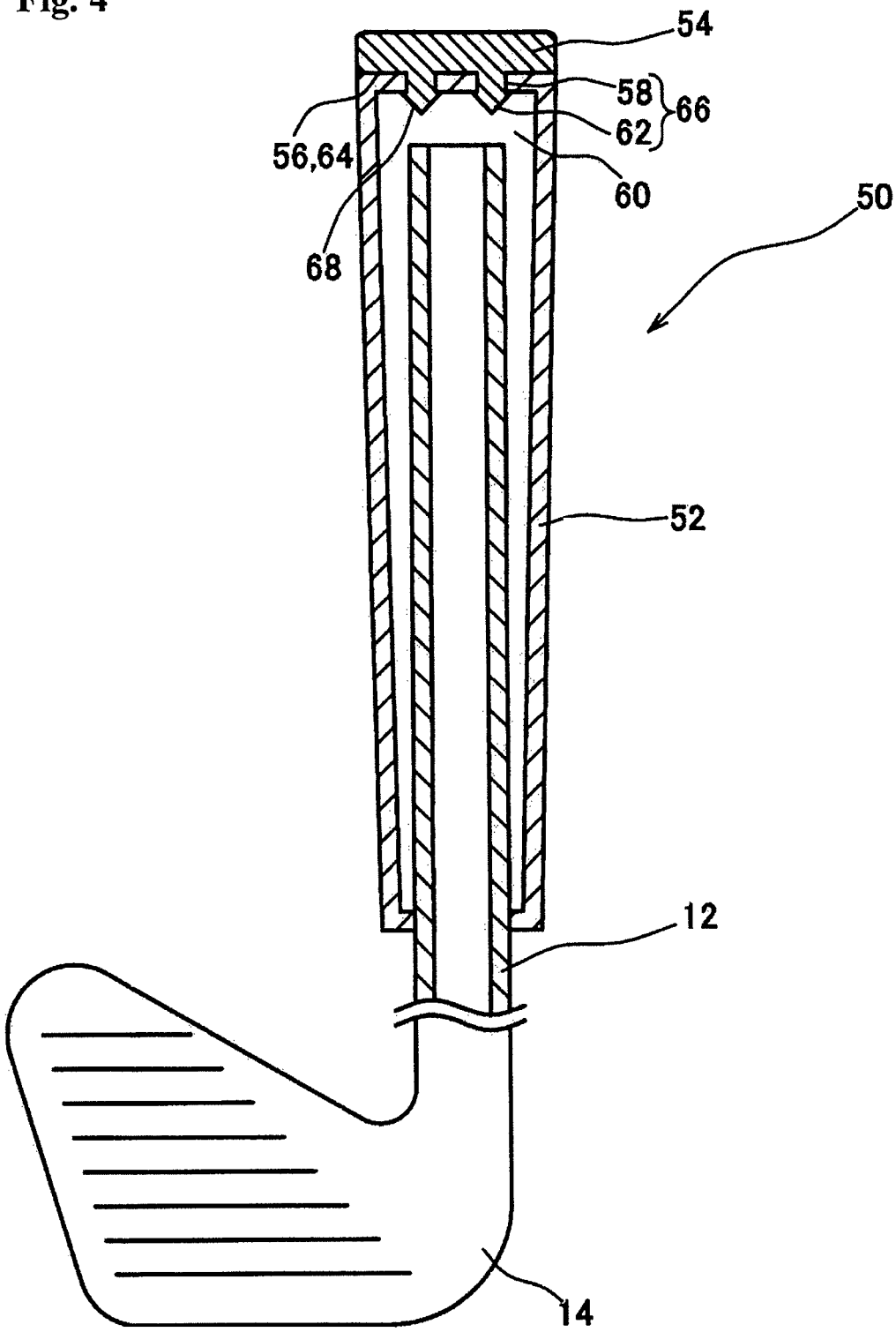
FIG. 4 is a cross sectional view showing the golf club relating to Second Embodiment of the present invention.
Figure 5:
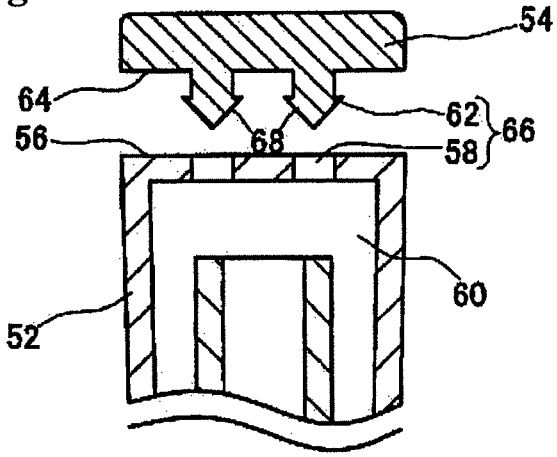
FIG. 5 is an exploded cross-sectional view showing the grip part and the weight part of the golf club relating to Second Embodiment of the present invention.

As shown in FIG. 4, the golf club 50 has substantially the same configuration as the golf club 10, and configurations of a grip part 52 and a weight part 54 are different. In addition, specifically, as shown in FIG. 4 and FIG. 5, two holes 58 (convex joining parts) are established in an end surface 56 of the grip part 52. The holes 58 are communicated with a space 60 formed between the end surface 56 of the grip part 52 and the end of the shaft 12.

The weight part 54 is an integration of a substantially-cylindrical portion functioning as a weight 60 for swingweight adjustment of the golf club 10 and the joining shaft 62 (convex joining part). The joining shaft 62 protrudes substantially perpendicularly from the end surface 64 of the weight part 54, and a folded engagement part 68 is established at the tip, respectively.

The engagement parts 68 are substantially conically-shaped, and they hook the holes 58 by intruding into the space 60 formed within the grip part 52 from the holes 58, respectively, and have a function to prevent the separation of the joining shaft 62 from the holes 58, respectively. The joining shafts 62 are placed in two sections on the end surface 64.

The joining shaft 62 is in a positional relationship corresponding to the hole 58 at the grip part 52 side, respectively. When the joining shafts 62 are inserted into the holes 58 until becoming the state where the engagement parts 68 protrude toward the space 60 side, the joint structure 66 is formed with the hole 58 and the joining shaft 62, respectively, and the weight part 54 and the grip part 52 are integrated.

As described above, in the golf club 50, the joint structures 66 with a combination of the hole 58 and the connecting shaft 64 are formed at a plurality of sections (two sections in the present embodiment) by inserting, fitting and joining the joining shaft 64 established at the weight part 54 side into the hole 58 established at the grip part 52 side, respectively. Therefore, even if inertial force is applied to the golf club 50 on the occasion of golf swing, any failures, such as relative rotation of the weight part 54 relative to the grip part 52 or separation of the weight part 54 from the grip part 52, will never occur.

Further, in the golf club 50, the weight part 54 is mounted to the end surface 56 of the grip part 52, and the center of gravity position can be slanted toward the grip part 52 side rather than the club head 14 side. Therefore, the golf club 50 enables easy adjustment so as to position the center of gravity at an appropriate balance point with consideration of the user's golf swing by adjusting the weight of the weight part 54.

As described above, in the golf club 50, the joint structures 66 can be formed by inserting and fitting a plurality of the joining shafts 62 into the holes 58 established at the corresponding positions at the grip part 52 side, respectively. Further, with the golf club 50, if the weight part 54 is pulled toward the direction away from the grip part 52 side, it is possible to easily detach the weight part 54 and to replace the weight part 54. Therefore, with the golf club 50, a swingweight can be easily adjusted.

In the golf club 50, the shaft center positions of the grip part 52 and the weight part 54 are substantially in common and the center of gravity of the weight part 54 exists at a position where the grip part 52 passes through the shaft center of the grip part 52. Consequently, in the golf club 50, a swingweight can be easily adjusted so as to position the center of gravity at an appropriate balance point even if the weight part 54 is mounted. Further, according to the joint structures 66, the weight part 54 is firmly secured to the grip part 52, and the weight part 54 will not rotate. Therefore, the golf club 10 has a stable center of gravity position and excels in usability.

In the present embodiment, the configuration where the holes 58 are placed at the grip part 52 side and the joining shafts 62 are placed at the weight part 54 side is exemplified, but the present invention shall not be limited to this configuration, and as long as the joint structures 66 are formable at a plurality of sections, the arrangement of the holes 58 and the joining shaft 62 can be any way.

Figure 6:
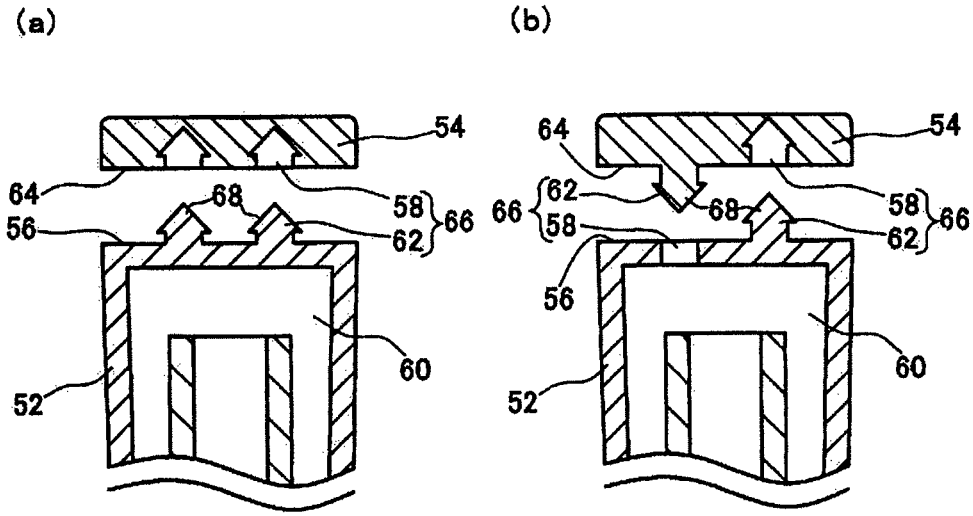
FIGS. 6 (*a*) and (*b*) are exploded cross-sectional views showing modified examples of the grip part and the weight part of the golf club shown in FIG. 4, respectively.

Specifically, for example, as shown in FIG. 6 (*a*), a configuration where the holes 58 are established at the weight part 54 side and the joining shafts 62 are established at the grip part 52 side is also acceptable. Further, as shown in FIG. 6 (*b*), another configuration where the holes 58 and the joining shaft 62 are established at both the grip part 52 side and the weight part 54 side so as to be in the mutually-fittable positional relationship. Even in the case of such configurations, while the weight part 54 is attachable/detachable as similar to the golf club 50, the weight part 54 can be firmly secured.

Further, in the present embodiment, the configuration where two each of the holes 58 and the joining shaft 62 are placed and the joint structures 66 are formed at two sections is exemplified, but the present invention shall not be limited to this configuration, and the joint structures 66 are formable at much more sections. Further, regarding the holes 58 and the joining shaft 62, one example of concave joining part and one example convex joining part were merely indicated, but another configuration is also acceptable as long as they are fitted into each other and the joint structures are formable.

Third Embodiment

Sequentially, a golf club 80 relating to Third Embodiment of the present invention is explained in detail with reference to drawings. Furthermore, any portions in common with the golf clubs 10 and 50 are marked with the same symbols, and any detailed explanation is omitted.

Figure 7:
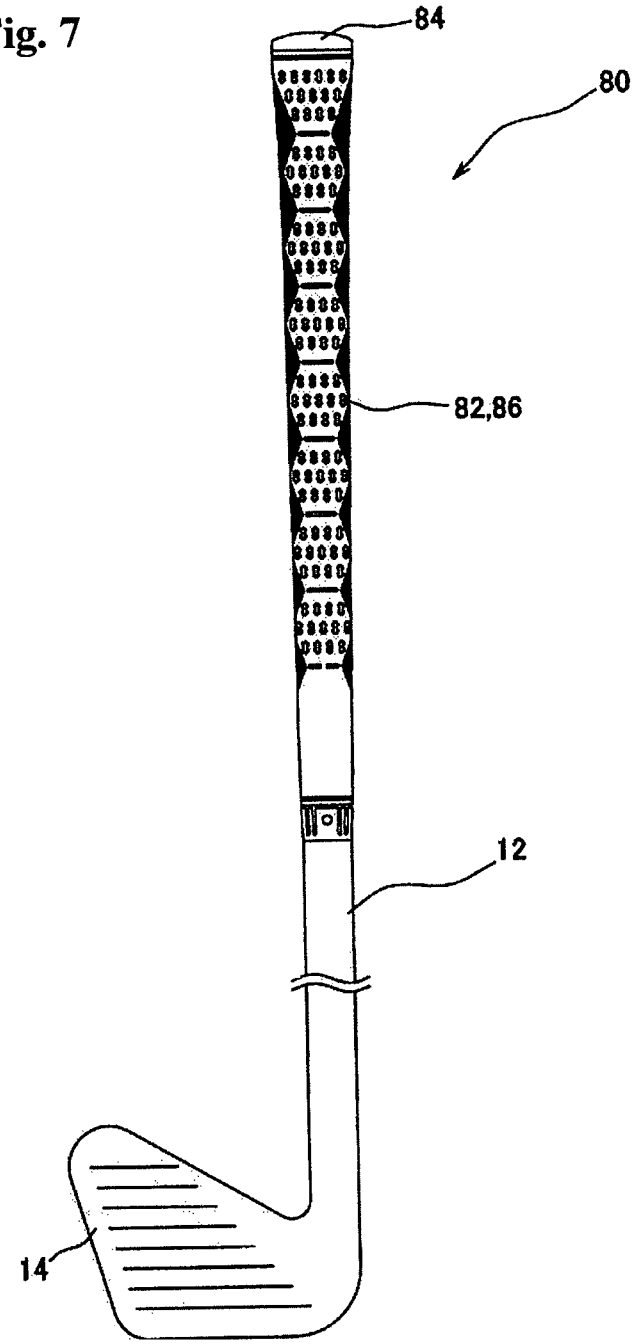
FIG. 7 is a front view showing the golf club relating to Third Embodiment of the present invention.
Figure 8:
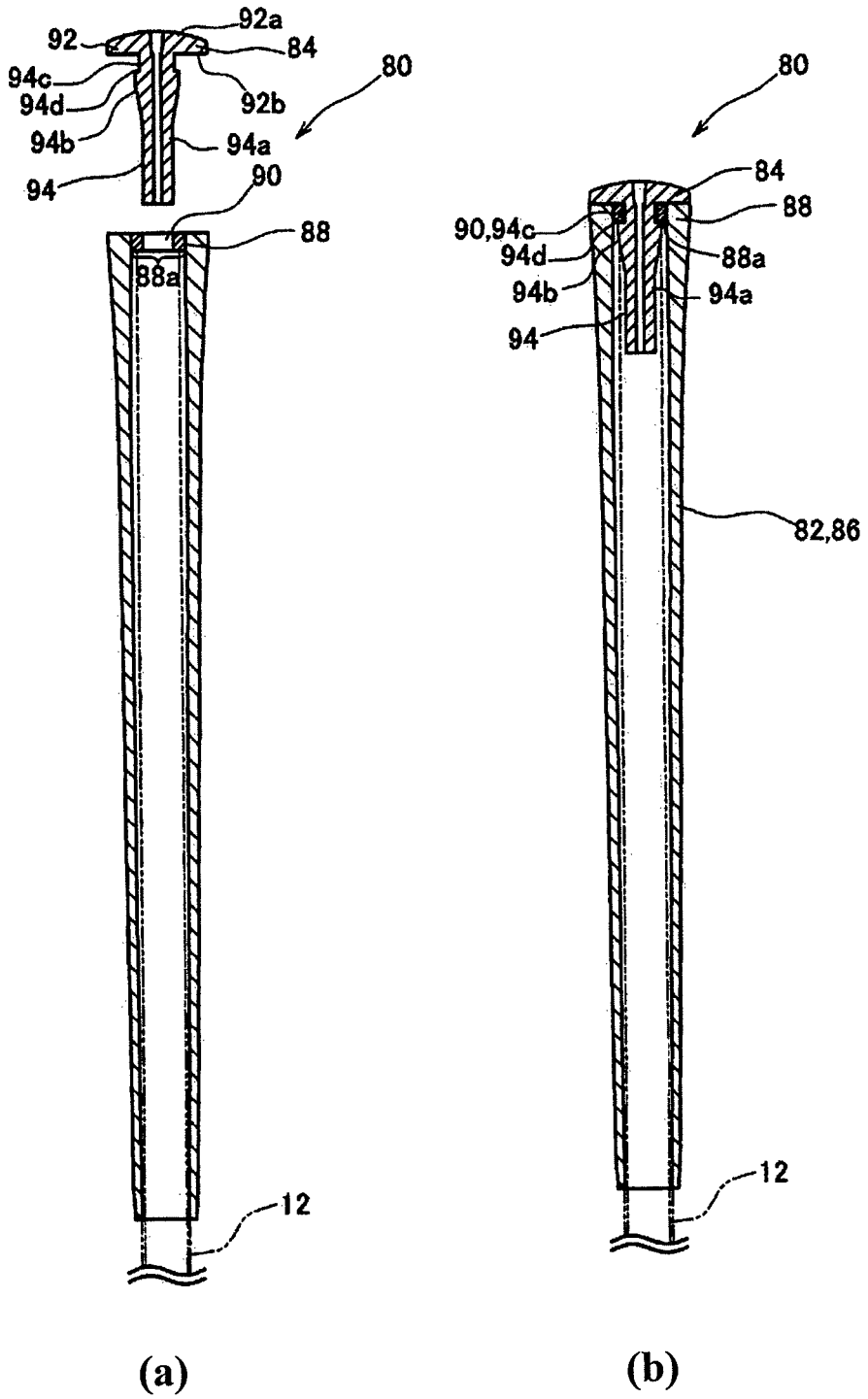
FIG. 8 includes cross sectional views of the golf club shown in FIG. 7, and (*a*) shows a state before mounting the weight part, and (*b*) shows a state after mounting the weight part.

As shown in FIG. 7, the golf club 80 has substantially the same configuration as the golf clubs 10 and 50, but configurations of a grip part 82 and a weight part 84 are different. Specifically, as shown in FIG. 7 and FIG. 8, the grip part 82 has a grip body 86 and a weight connection part 88. The grip body 86 is a cylindrical hollow portion to be gripped by a user, and the shaft 12 is inserted from the opening established at one end side. The grip body 86 is made from a polymer material (elastomer) having a rubber-like elasticity, like any of rubbers, such as natural rubber or synthetic rubber, and has elasticity at least radially.

Figure 9:
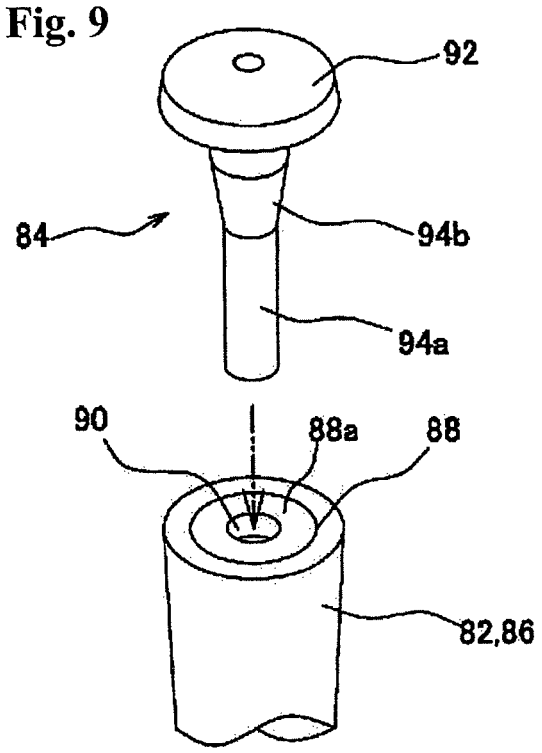
FIG. 9 is a main part enlarged perspective view showing a state before mounting the weight part in the golf club shown in FIG. 7.

As shown in FIG. 8 and FIG. 9, the weight connection part 88 is disc-shaped (or ring-shaped) having a slot 90 substantially in the center radially, and closes the end portion of the grip body 86. A disc portion 88*a* having the slot 90 out of the weight connection part 88 is made from a polymer material (elastomer) having rubber-like elasticity as similar to the grip body 86, and this is designed to be harder than the grip body 86. Consequently, the disc part 88*a* is more difficult to be deformed than the grip body 86, and the inserted weight part 84 is firmly retained. For the grip body 86, the disc part 88*a* is pre-formed and the disc part 88*a* is inserted into a mold, and then, the grip body 86 is formed by integrally molding the grip part 82 with the disc part 88*a* using injection molding. The slot 90 is formed from a hole having a substantially circle opening shape, and this is a portion where an insertion part 94 of the weight part 84 to be described in detail later is inserted. It is needless to say, without using the disc portion 88*a* as another material, the grip body 86 including the grip part 82 and the weight connection part 88 can be integrally molded with the same material.

Figure 10:
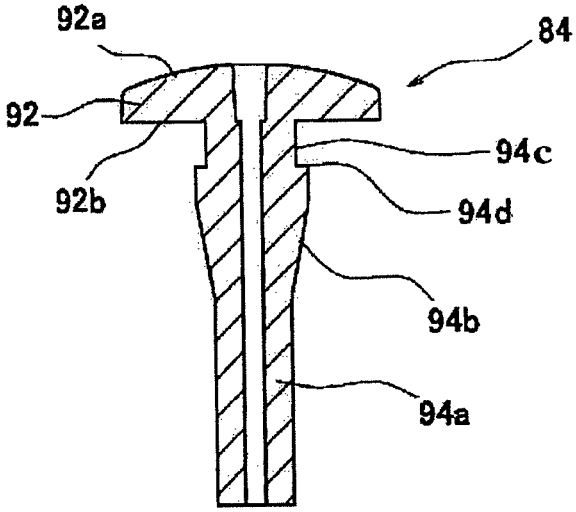
FIG. 10 is a cross sectional view showing the weight part.

As shown in FIG. 8 to FIG. 10, the weight part 84 has a weight 92 and an insertion part 94. The weight 92 is a portion to function as a weight for swingweight adjustment in the golf club 80. The weight part 84 can have an appropriate shape, such as a rough cylinder, as similar to the weight parts 18 and 54 in the golf clubs 10 and 50, respectively. In the present embodiment, the weight 92 is disc-shaped having substantially the same diameter as the external diameter of the weight connection part 88 of the grip part 82, and a surface 92*a* is gently curved to rise toward the center shaft position, and a rear surface 92*b* is flat shape.

The insertion part 94 is a shaft-like portion substantially-vertically arranged relative to the rear surface 92*b*. As shown in FIG. 10, the insertion part 94 is broadly divided into three portions, a tip part 94*a*, a larger diameter part 94*b* and an engagement part 94*c*, from the tip side. The tip part 94*a* is a shaft-like portion having the same dimension or less of external diameter compared to the opening diameter of the slot 94. Consequently, the insertion part 94 can be smoothly inserted and extracted into/from the slot 90 placed in the weight connection part 88.

A diameter-enlarging part 94*b* is positioned between the tip part 94*a* and the engagement part 94*c*, and has a taper-like portion formed having an external diameter becoming enlarged from the tip part 94*a* side toward the engagement part 94*c*. For the external diameter of the diameter-enlarging part 94*b*, a portion at the engagement part 94*c* is greater than the opening diameter of the slot 90 established in the weight connection part 88. Consequently, if the weight part 84 is further pressed radically under the condition where the tip part 94*a* is inserted into the slot 90, the weight connection part 88 is elastically deformed and the slot 90 is extended by force by the diameter-enlarging part 94*b*.

The engagement part 94*c* is positioned at a base end section of the insertion part 94, i.e., between the diameter-enlarging part 94*b* and a rear surface 92*b* of the weight 92, and is a portion engaged with the slot 90 placed in the weight connection part 88. The outer diameter of the engagement part 94*c* is almost the same as the opening size of the slot 90 or greater. Consequently, the external diameter of the insertion part 94 is drastically changed after the boundary portion between the larger diameter part 94*b* and the engagement part 94*c*, and a step difference 94*d* is formed between both. Further, the axial length of the engagement part 94*c* is substantially the same as the thickness of the weight connection part 88. Consequently, when the insertion part 94 is pushed into the slot 90 and the engagement part 94*c* is engaged with the slot 90, the step difference 94*d* and the weight connection part 88 are hooked with each other and the rear surface 92*b* of the weight 92 becomes substantially adhered closely and firmly to the weight connection part 88. In addition, when the insertion part 94 is inserted until the engagement part 94*c* reaches the slot 90, because friction force acts on the occasion that the diameter-enlarging part 94*b* passes through the slot 90 is released and they are engaged, appropriate feeling of moderation can be obtained and a user can feel a sensation where the weight part 84 is firmly secured. Further, in the present embodiment, since the weight connection part 88 is made of a material that is harder than that of the grip part 82, the connection strength on the occasion of connecting the weight part 84 is high.

Further, in the golf club 80 of the present embodiment, since the grip body 86 is softer than the weight connection part 88, a gap can be easily widened by inserting a nail between the rear surface 92*b* of the weight 92 and the weight connection part 88. Therefore, with the golf club 80 of the present embodiment, not only mounting the weight part 84 but detachment of the weight part 84 for the purpose of replacement can be easily implemented.

Figure 11:
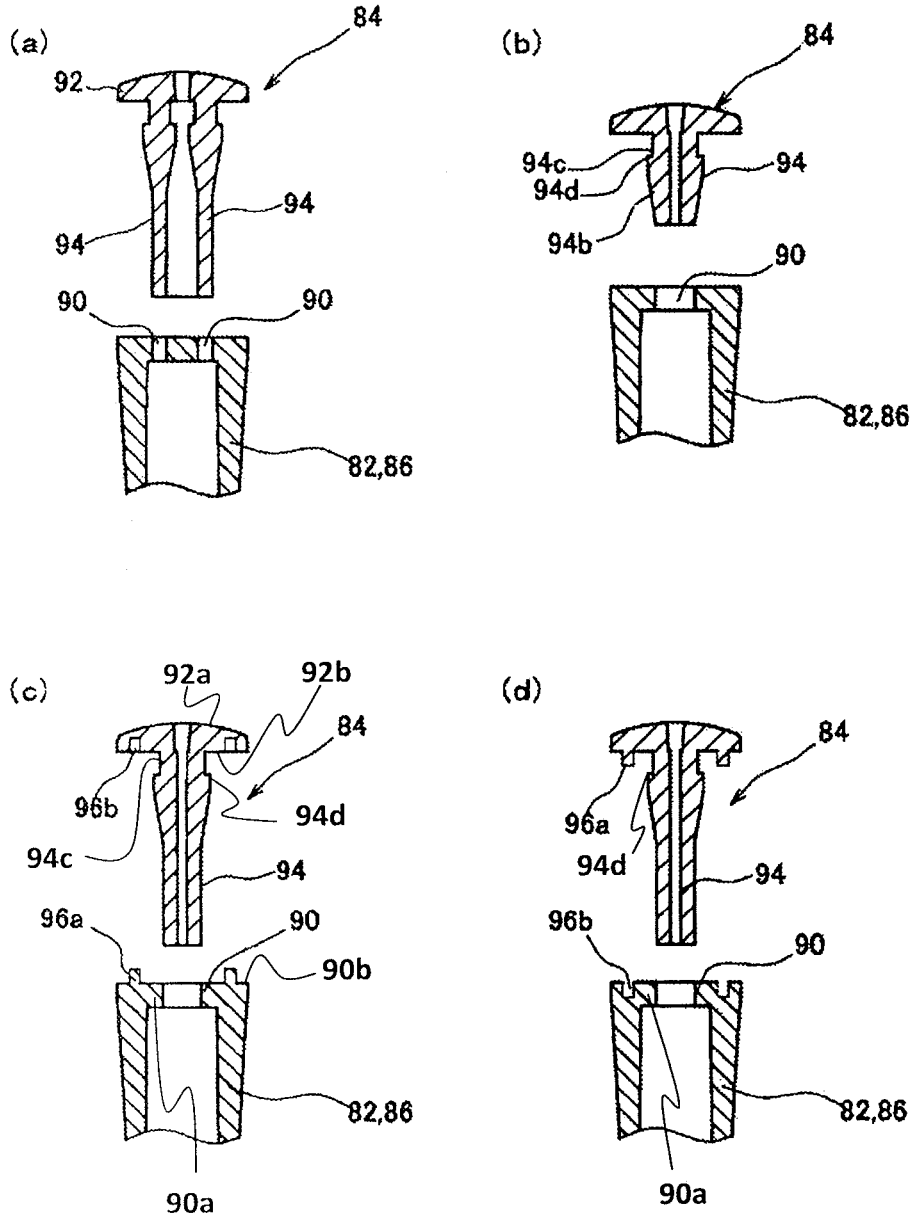
FIGS. 11 (*a*) to (*d*) are detached states of the grip part and the weight part relating to the modified examples of the golf club showing in FIG. 7, respectively.

In the present embodiment, the configuration where the insertion part 94 is placed in the center of the weight part 84 and the slot 90 is placed in the center of the weight connection part 88 is exemplified, but the present invention is not limited to this one but a configuration where the insertion part 94 and the slot 90 are placed at positions off the center of the weight part 84 and the weight connection part 88, respectively, is adoptable. Further, in the embodiment, the configuration where one of each of the insertion part 94 and the slot 90 are placed is exemplified, but for example, as shown in FIG. 11 (*a*), a configuration where a plurality of components equivalent to the insertion part 94 and the slot 90 are placed is also adoptable. According to such configuration, it is possible to further improve the connection strength between the grip part 82 and the weight part 84, and even when the heavier weight 92 is used for the weight part 84, rotation or separation of the weight part 84 can be prevented. Furthermore, the disc part 88*a* is omitted in FIG. 11.

In the golf club 80 of the present embodiment, the grip part 82 and the weight part 84 can be positioned by inserting the tip part 94*a* of the insertion part 94 into the slot 90, and a position shift at the time of inserting the insertion part 94 can be prevented. Furthermore, the configuration of the insertion part 94 is merely one example of the present invention, and for example, as shown in FIG. 11 (*b*), a configuration without the tip part 94*a* is also adoptable.

In the golf club 80 of the present embodiment, the weight connection part 88 is made of elastomer, such as rubber, and since the rear surface 92*b* of the weight 92 is substantially adhered firmly to the weight connection part 88 by mounting the weight part 84, great friction force is applied to the weight 92. Consequently, with the golf club 80 of the present embodiment, failures, such as rotation or separation of the weight 92 in association with golf swing, will never occur. Furthermore, the configurations of the weight part 84 and the weight connection part 88 are not limited to those mentioned above, but for example as shown in FIGS. 11 (*c*) and (*d*), a configuration where protrusion parts 96*a* are placed at either the weight connection part 88 or the rear surface 92*b* of the weight 92 are established and concave parts 96*b* for fitting the protrusion part 96*a* are established at corresponding positions is also adoptable. According to such configuration, when the weight part 84 is mounted, the protrusion parts 96*a* are fitted into the concave parts 96*b* and it is possible to further prevent failures, such as rotation or separation of the weight part 94*b* at the time of golf swing.

In the weight part 84 exemplified in the present embodiment, the external diameter of the diameter-enlarging part 94*b* continuously expands as toward the base end side (weight side) from the axial tip side of the insertion part 94, but the present invention is not limited to this configuration, and any configuration is adoptable as long as the external diameter expands gradually, and for example, a configuration where the external diameter of the diameter-enlarging part 94*b* expands by stages is adoptable.

In the present embodiment, in order to improve the anchorage strength of the weight part 84, the example where the weight connection part 88 of the grip part 82 is made of a material harder than the grip body 86 is exemplified, but the present invention is not limited to this one, and both can have the same hardness. Further, in the present embodiment, the method where the grip body 86 is produced by injection molding and the grip part 82 is produced by integrating with the prepared weight connection part 88 is exemplified, but the grip part 82 can be produced by another method.

As described above, the typical embodiments of the present invention were explained, and various design changes are applicable within the scope of technical concept of the present invention, respectively. For example, in the embodiments, the modes where the weight parts 18, 54 and 84 also function as a weight (in other words, modes where they are integrated by disabling detachment/attachment) are adopted, but for example, a weight may be integrated with the weight part detachably, as another member. According to such mode, it is also possible to appropriately control the weight of the weight part.

Figure 12:
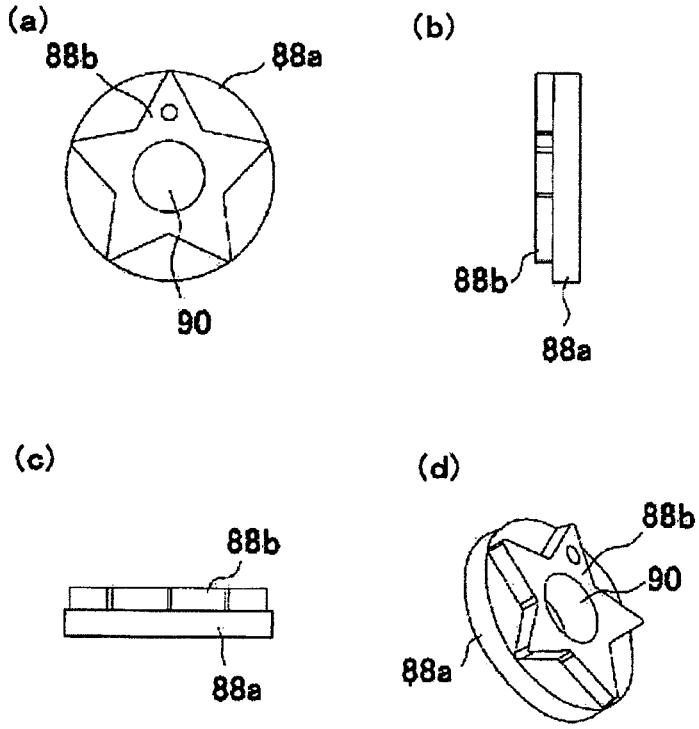
FIG. 12 is schematic perspective view showing another mode of a disc part 88*a* having a slot 90 within a weight connection part 88.

Further, for the disc part 88*a* having the slot 90 out of the weight connection part 88, as shown in FIG. 12, for example, a star-shaped part 88*b* is also adoptable. If the disc part having such star-shaped part is adoptable (for example, with a ratio of one out of 10,000 units), it is preferable because a user feels fortunate and the golf club is expected to provide a mentally favorable impact on his/her game of golf.

In an embodiment, as illustrated in FIGS. 8(*a*)(b), the grip structure of a golf club includes a grip part (82) and a weight part (84). The grip part (82) has a cylindrical grip body (16), as shown in FIG. 1, extending perpendicularly.

In FIG. 11(*c*)(*d*), the grip part (82) has a weight connection part (88) at a top end (90*b*) of the cylindrical grip body (16). The weight connection part (88) has a disc part (90*a*) inwardly extended from the cylindrical grip body (16) and a slot (90) provided in a center of the disc part. The weight part (84) has an insertion part (94) extending perpendicular, having an engagement part (94*c*) and a step difference (94*d*) provided below the engagement part (94*c*). The step difference (94*d*) is outward extended from the engagement part (94*c*). A weight (92) is provided above the insertion part (94). The weight (92) has a top surface (92*a*) and a rear surface (92*b*). As illustrated in FIGS. 11(*c*)(*d*), one of the top end (90*b*) and the rear surface (92*b*) has protrusion parts (96*a*), and the other of the top end (90*b*) and the rear surface (92*b*) has concave parts (96*b*). The weight part (84) is detachably mounted to the grip part (82) such that the insertion part (94) is inserted in the slot, in which the disc part (90*a*) is engaged with the step difference (94*d*) and the protrusion parts (96*a*) are engaged with the concave parts (96*b*). Therefore, the weight part (84) functions as swingweight adjustment.

The grip structure with a weight relating to the present invention is applicable to all goods having a grip, such as golf clubs or tennis rackets, and since the center gravity of the weight part exists on the center shaft of the grip part in the goods equipped with the grip structure having a weight relating to the present invention, a swingweight can be easily adjusted so as to position the center of gravity at an appropriate balance point and the center of gravity position can be stabilized; therefore, goods excelling in usability especially at the time of golf swing can be obtained.

What is claimed is:

1. A grip structure of a golf club comprising a grip part and a weight part, wherein the grip part comprises:

a cylindrical grip body; and a weight connection part at a top end of the cylindrical grip body; wherein the weight connection part comprises a disc part inwardly extended from the cylindrical grip body and a slot provided in a center of the disc part, and wherein the weight part comprises:

an insertion part, having an engagement part and a step difference provided below the engagement part, the step difference being outward extended from the engagement part, a weight provided above the insertion part having a top surface and a rear surface, wherein the rear surface has protrusion parts, and the top end has concave parts, wherein the weight part is detachably mounted to the grip part such that the insertion part is inserted in the slot, in which the disc part is engaged with the step difference and the protrusion parts are engaged with the concave parts, wherein the weight part functions as swingweight adjustment.

2. The grip structure of claim 1, wherein a center of gravity of the weight part is positioned on a shaft center of the grip part.

3. The grip structure of claim 1, wherein the weight connection part is elastically deformable, and is harder than the cylindrical grip body and integrally formed with the cylindrical grip body.

4. A golf club equipped with the grip structure of claim 1, wherein a center gravity of the golf club is adjusted by the weight part.

* * * * *